US006394597B1

(12) United States Patent
Koike et al.

(10) Patent No.: US 6,394,597 B1
(45) **Date of Patent: *May 28, 2002**

(54) INK-JET PRINTING CLOTH, AND INK-JET PRINTING PROCESS AND PRODUCTION PROCESS OF PRINT USING THE SAME

(75) Inventors: Shoji Koike, Yokohama; Masahiro Haruta, Tokyo; Yasushi Miura; Koromo Shirota, both of Kawasaki; Aya Takaide, Yokohama; Tomoya Yamamoto, Kawasaki; Yoshiko Miyashita, Kawasaki; Mariko Suzuki, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/382,806

(22) Filed: Feb. 2, 1995

(30) Foreign Application Priority Data

Feb. 8, 1994 (JP) ..... 6-014414
Jan. 9, 1995 (JP) ..... 7-001333

(51) Int. Cl.[7] ..... B41J 3/407
(52) U.S. Cl. ..... 347/106
(58) Field of Search ..... 347/106, 105

(56) References Cited

U.S. PATENT DOCUMENTS

| | | | | |
|---|---|---|---|---|
| 4,597,794 | A | 7/1986 | Ohta et al. | 106/20 |
| 4,689,078 | A | 8/1987 | Koike et al. | 106/22 |
| 4,702,742 | A | 10/1987 | Iwata et al. | 8/495 |
| 4,725,849 | A | 2/1988 | Koike et al. | |
| 4,849,770 | A | 7/1989 | Koike et al. | |
| 4,969,951 | A | 11/1990 | Koike et al. | 106/22 |
| 5,250,121 | A | 10/1993 | Yamamoto et al. | 106/22 R |
| 5,358,558 | A | 10/1994 | Yamamoto et al. | 106/22 R |
| 5,396,275 | A | 3/1995 | Koike et al. | 347/101 |
| 5,500,023 | A | 3/1996 | Koike et al. | 8/499 |
| 5,515,093 | A | 5/1996 | Haruta et al. | 347/101 |

FOREIGN PATENT DOCUMENTS

| | | | | |
|---|---|---|---|---|
| EP | 558914 A1 | | 9/1993 | |
| EP | 0620116 A2 | * | 10/1994 | 347/106 |
| EP | 0 621 367 A1 | | 10/1994 | |
| JP | 61132687 | * | 6/1986 | 347/106 |
| JP | 62299588 | | 12/1987 | |
| JP | 02-242962 | * | 9/1990 | |

* cited by examiner

*Primary Examiner*—John Barlow
*Assistant Examiner*—Michael S Brook
(74) *Attorney, Agent, or Firm*—Fitzpatrick, Cella, Harper & Scinto

(57) ABSTRACT

Disclosed herein is an ink-jet printing cloth which is dyed with inks containing a reactive dye and is composed mainly of silk fibers, wherein the cloth contains an alkaline substance in an amount of 0.01 to 0.8% by weight based on the dry weight of the cloth.

32 Claims, 2 Drawing Sheets

INK-JET PRINTING CLOTH, AND INK-JET PRINTING PROCESS AND PRODUCTION PROCESS OF PRINT USING THE SAME

BACKGROUND OF THE INVENTION

1. Field of the Invention

The present invention relates to an ink-jet printing cloth and an ink-jet printing process. In particular, this invention relates to an ink-jet printing cloth which is composed mainly of silk fibers having good stability with time, and is good in stability to coloring in high-temperature fixing and capable of providing highly colored, bright and fine patterns with high color yield upon formation of a print image by an ink-jet system, and an ink-jet printing process and a production process of a print using such a cloth.

2. Related Background Art

At present, textile printing is principally conducted by screen printing or roller printing. Both methods requires to form a plate, and are hence unfit for multi-kind small-quantity production and difficult to quickly cope with the fashion of the day. Therefore, there has recently been a demand for development of an electronic printing system making no use of any plate. In compliance with this demand, many textile printing processes according to ink-jet recording have been proposed. Various fields expect much from such textile printing processes even in dyeing on cloths composed mainly of silk.

Ink-jet printing cloths composed mainly of silk and used in such a system are required to have the following performance characteristics:

(1) being colored with an ink to a sufficient color depth;

(2) being high in color yield of ink;

(3) having no influence on mechanical properties and coloring properties during storage after a pretreatment;

(4) causing little irregular bleeding of inks on the cloth;

(5) being excellent in feedability in apparatus; and (6) being good in stability to coloring in high-temperature fixing.

In ink-jet printing on cloths composed mainly of silk fibers, a system using inks containing an acid dye as a dye has heretofore been a mainstream.

However, textile printing with reactive dyes is also required in a dyeing field of which high concentration and wet color fastness are required. An alkaline substance is indispensable for the use of the reactive dyes. When the silk fibers are brought into contact with an alkali for a long period of time, their mechanical strength is lowered, and problems of deteriorated hand and coloring irregularity are offered. It is therefore essential to minutely control the conditions of the application of the alkali. Any measure for solving these problems has not been yet disclosed to date.

Detailed investigations have also been made on the influence of heating means. More specifically, fixing conditions of 80° C. to 102° C. or so do not offer a very serious problem. If a fixing temperature is preset to conditions exceeding 103° C. to enhance dyeing efficiency, however, silk fibers offers a problem of their own that the color yield is rapidly lowered unlike the case of other reactive dye-dyeable fibers typified by cellulose fibers.

Against this problem of lowered color yield, a measure on cellulose fiber that an antireductant is added together with an alkaline substance with a view toward preventing coloring ability from lowering due to the reductive decomposition of dyes upon steaming is disclosed in Japanese Patent Application Laid-Open No. 62-299588. The cause of deteriorating the coloring ability in the silk fibers is different from that in the cellulose fibers and considered to be attributable to hydrolysis attendant upon change in coloring temperature rather than the reductive decomposition of dyes. It is therefore necessary to propose a measure for overcoming this problem by an absolutely different idea.

As described above, means capable of satisfying the above individual performance characteristics to some extent have been able to be found in the prior art. However, there have not been yet known under the circumstances any ink-jet printing cloth composed mainly of silk and any ink-jet printing process, which can satisfy all the above-mentioned performance characteristics at the same time, solve such a series of problems and provide the highest-quality image.

SUMMARY OF THE INVENTION

It is therefore an object of the present invention to provide an ink-jet printing cloth and an ink-jet printing process, which satisfies, at the same time, the above-described general problems involved in the conventional ink-jet printing cloths, i.e., a problem of image that a bright print free of ink bleeding and high in color depth is provided, a problem of quality that coloring ability in high-temperature fixing is stable, a problem of cost that the color yield of ink is good, a problem of operating characteristics or properties such as storage stability and feedability in apparatus of treated cloth, etc.

The above object can be achieved by the present invention described below.

According to the present invention, there is thus provided an ink-jet printing cloth which is dyed with inks containing a reactive dye and is composed mainly of silk fibers, wherein the cloth contains an alkaline substance in an amount of 0.01 to 0.8% by weight based on the dry weight of the cloth.

According to the present invention, there is also provided an ink-jet printing cloth which is dyed with inks containing a reactive dye and is composed mainly of silk fibers, wherein the cloth contains an alkaline substance in an amount not less than 0.8% by weight based on the dry weight of the cloth, and the surface pH of the cloth is adjusted to 8.2 or lower.

According to the present invention, there is further provided an ink-jet printing process comprising applying inks containing a reactive dye to a cloth, wherein said cloth is one of the ink-jet printing cloths described above, and a dyeing treatment is carried out at 103° C. or higher at least after the application of the inks to the cloth, followed by a washing treatment.

According to the present invention, there is still further provided a process for producing a print, comprising applying inks containing a reactive dye to a cloth by an ink-jet system, wherein said cloth is one of the ink-jet printing cloths described above, and a dyeing treatment is carried out at 103° C. or higher at least after the application of the inks to the cloth, followed by a washing treatment.

DESCRIPTION OF THE PREFERRED EMBODIMENTS

Figure 1:
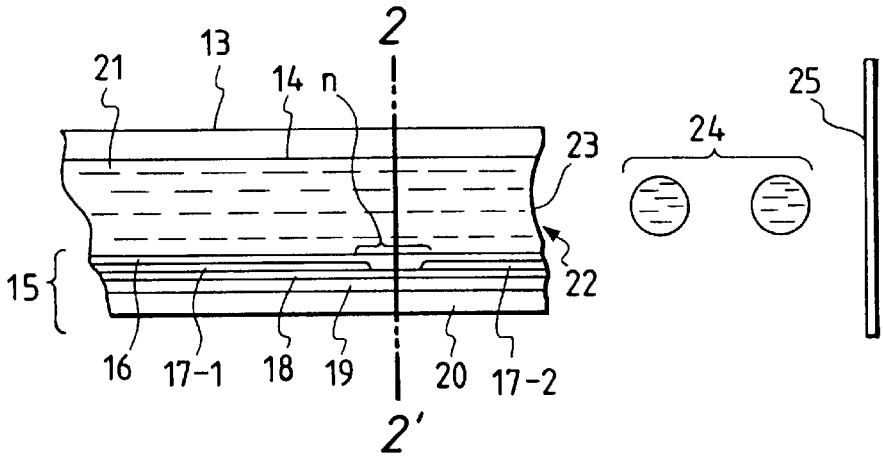
FIG. 1 is a longitudinal cross-sectional view of a head of an ink-jet recording apparatus.

An ink-jet printing process, in which an ink markedly low in viscosity compared with the conventional printing pastes is used, and an image is formed by dot expression of this ink, has extremely many limitations on pretreatment conditions of cloth compared with other textile printing processes. That influence is particularly great in the case where a cloth composed mainly of silk fibers is dyed with inks containing a reactive dye.

In the case of the dyeing with inks containing a reactive dye, an alkaline agent is an essential component as a catalyst. However, the silk fibers undergo a chemical change by the alkaline agent. Therefore, they may bring about changes in properties with time after their treatment according to the conditions of the treatment. It is thus necessary to strictly limit the conditions of the pretreatment.

Besides, if a steaming treatment is conducted at such a high temperature as exceeds 103° C., a ratio of a reaction rate between the reactive dye and the silk fibers to a rate of hydrolysis of the dye markedly changes, and so a proportion of hydrolysis rapidly increases. For this reason, color yield is lowered to a great extent and stability to coloring is deteriorated. This phenomenon is considered as a phenomenon characteristic of the silk fibers because it is extremely rare in cellulose fibers compared with the silk fibers, which thus causes no problem in actual use.

The present inventors have carried out improvement in ink-jet printing cloths composed mainly of silk fibers with a view toward allowing them to satisfy the various performance characteristics as described above at the same time. As a result, it has been found that when the absolute weight of an alkaline substance based on the cloth is controlled to a certain range, or the surface pH of the cloth is controlled to a specific range with an acid if the content of the alkaline substance exceeds the upper limit of this range, the above characteristics or properties are improved to a marked extent, thus leading to completion of the present invention.

The present invention will hereinafter be described in more detail by the following preferred embodiments.

The ink-jet printing cloth according to the first embodiment of the present invention is composed mainly of silk fibers. The cloth is characterized in that it contains an alkaline substance in an amount of 0.01 to 0.8% by weight based on the dry weight of the cloth.

The term "printing cloth" as used herein means a woven fabric, nonwoven fabric, knitted fabric, felted fabric or the like composed principally of silk yarn. It goes without saying that the cloth is preferably formed of silk fibers alone. However, blended woven fabrics or nonwoven fabrics of silk fibers and one or more other materials may also be used as ink-jet printing cloths in the present invention so far as they contain silk fibers at a blending ratio of at least 70%, preferably at least 80%.

With respect to the silk cloth mainly constituting the ink-jet printing cloth, the average thickness of the fibers is controlled to 2.2 to 3.5 deniers, preferably 2.5 to 3.3 deniers. The average thickness of the silk yarn formed of the silk fibers is controlled to 14 to 147 deniers, preferably 14 to 126 deniers, more preferably 14 to 105 deniers. The silk yarn may preferably be formed into a cloth by any conventional method to use it in the present invention. With respect to the measurement of the average thickness of the fibers, their Micronaire fineness is determined by the Micronaire method, and the value is converted into the weight per 9000 m to express it in terms of a denier unit. If average thicknesses of the silk fibers and silk yarn are thinner than the lower limits or thicker than the upper limits of the above described ranges, the entanglement of the silk fibers may become improper, thus resulting in a cloth poor in dyeing properties, color yield, resistance to bleeding and fixing ability as to inks, and its feedability in apparatus.

Examples of the alkaline substances used in the present invention include alkali metal hydroxides such as sodium hydroxide and potassium hydroxide; amines such as mono-, di- and triethanolamines; alkali metal carbonates and bicarbonates such as sodium carbonate, potassium carbonate and sodium bicarbonate; metal salts of organic acids such as calcium acetate and barium acetate; ammonia; and ammonium compounds. Further, sodium trichloroacetate and the like, which form an alkaline substance by steaming or under dry heat, may also be used. Sodium carbonate and sodium bicarbonate are particularly preferred alkaline substances.

When the alkaline substance is applied to the cloth in an amount of 0.01 to 0.8% by weight based on the dry weight of the cloth, the object of the present invention can be achieved irrespective of the surface pH of the cloth after the pretreatment. The amount to be applied is more preferably 0.05 to 7% by weight, most preferably 0.1 to 0.6% by weight.

The object of the present invention can also be achieved when the alkaline substance is applied in an amount not less than 0.8% by weight based on the dry weight of the cloth, and the surface pH of the cloth is adjusted to 8.2 or lower as the second embodiment of the present invention. In this case, the surface pH is more preferably adjusted to 6 to 8, most preferably 6.5 to 8. In order to achieve the above surface pH, an acid may be used as needed, thereby adjusting the pH of the alkaline substance. Although any acid may be used in this case, it is preferable to use an organic acid and a salt thereof (according to the pH intended). It is more preferable to use an organic carboxylic acid, organic sulfonic acid or a salt thereof.

The adjustment of the pH may be performed either by adjusting the pH of a pretreatment solution containing the alkaline substance in advance or by subjecting the cloth after the pretreatment with the alkaline substance to an after-treatment with the acid so as to adjust the surface pH to 8.2 or lower.

The term "surface pH" as used herein means a value measured by the same means as described in "Surface pH Measurement of Paper and and Paperboard" prescribed by Japan Technical Association of the Pulp and Paper Industry, which is as follows.

The following three methods can be used for measuring pH around the surface of paper and paperboard.

METHOD OF APPLICATION

This method can be applied to paper and paperboard. However, this method is not used for coated paper and non-white paper since properties of the base paper cause an adverse influence.

ONE DROPPING EXTRACTION METHOD

This method can be applied to paper and paperboard. However, when paper having high water absorbability and non-white paper are used, this method may cause unclear print.

SURFACE-RELEASE EXTRACTION METHOD

This method can be applied to coated paper, colored paper and paperboard.

Test Procedures

METHOD OF APPLICATION

Instruments and reagents:

(1) The following indicators for pH measurement are used.

A moisture regain suitable for the ink-jet printing cloths according to the present invention is within a range of from 17 to 112%, preferably from 18 to 92%, more preferably from 19 to 72%. If the moisture regain is lower than 17%, disadvantages may arise from the viewpoints of coloring ability and color yield. On the other hand, any moisture regain exceeding 112% tends to offer problems from the viewpoints of feedability and particularly, resistance to bleeding. Incidentally, the official moisture regain of raw silk is 12%.

The measurement of the moisture regain in the cloth was conducted by reference to JIS L 1019. More specifically, 100 g of a sample was precisely weighed and placed in an oven at 105±2° C., thereby drying the sample to a constant weight. Thereafter, the cloth was washed with water and then dried again to a constant weight to measure the weight of fibers alone after the drying. The moisture regain was then determined in accordance with the following equation:

$$\text{Moisture regain } (\%)=\{(W-W')/W''\}\times 100$$

wherein W is a weight before the drying, W' is a weight after the drying, and W" is a weight of fibers after the water washing and drying.

The ink-jet printing cloths according to the present invention may be subjected to any pretreatment routinely used as needed. In particular, cloths containing at least one substance selected from the group consisting of water-soluble metal salts, water-soluble polymers, urea and thiourea in an amount of 0.01 to 20% by weight may be more preferred in some cases.

Examples of the water-soluble polymers include natural water-soluble polymers such as starches from corn, wheat and the like, cellulosic substances such as carboxymethylcellulose, methylcellulose and hydroxyethylcellulose, polysaccharides such as sodium alginate, gum arabic, locust bean gum, tragacanth gum, guar gum and tamarind seed, proteins such as gelatin and casein, tannin and derivatives thereof, and lignin and derivatives thereof.

Examples of synthetic polymers include polyvinyl alcohol type compounds, polyethylene oxide type compounds, water-soluble acrylic polymers, water-soluble maleic anhydride polymers and the like. Of these, the polysaccharide polymers and cellulosic polymers are preferred.

Examples of the water-soluble metal salts include compounds such as halides of alkali metals and alkaline earth metals, which form typical ionic crystals. As representative examples of such compounds, may be mentioned NaCl, $Na_2SO_4$ and KCl for alkali metals, and $CaCl_2$ and $MgCl_2$ for alkaline earth metals. Of these, salts of Na, K and Ca are preferred.

As inks used for the ink-jet printing cloths according to the present invention, it is essential to use ink-jet printing inks comprising a reactive dye and an aqueous liquid medium.

Among others, substitution reaction type dyes are reactive dyes which can manifest the effects to a marked extent in the process of the present invention. In particular, reactive dyes having a monochlorotriazine group are effective. Specific examples of these dyes include those typified by C.I. Reactive Yellow 2, 85 and 95; C.I. Reactive Red 24, 31, 218 and 226; C.I. Reactive Blue 13, 15, 49, 71 and 72; and C.I. Reactive Orange 5 and 13.

These dyes may be contained in an ink either singly or in any combination with dyes of the same or different hues. The total amount of the dyes to be used is generally within a range of from 0.5 to 30% by weight, preferably from 1 to 25% by weight, more preferably from 2 to 20% by weight based on the total weight of the ink.

It is also preferred embodiments to add a chloride ion and/or a sulfate ion to the ink used in the process of the present invention in a proportion of about 10 to 20,000 ppm based on the reactive dye(s) contained in the ink, and to add at least one substance selected from the group consisting of silicon, iron, nickel and zinc to the ink in a proportion of about 0.1 to 30 ppm in total. As a result, when ink-jet printing is conducted with such inks on the ink-jet printing cloth according to the present invention, a bright print high in color yield, free of any bleeding and higher in color depth can be obtained.

Further, calcium and/or magnesium may preferably be contained in the ink in a total amount ranging from 0.1 to 30 ppm, preferably from 0.2 to 20 ppm, more preferably from 0.3 to 10 ppm in combination with the metal salts mentioned above because the color yield can be more enhanced.

Water which is a principal component of the liquid medium making up the ink used in the ink-jet printing process of the present invention is used within a range of from 30 to 90% by weight, preferably from 40 to 90% by weight, more preferably from 50 to 85% by weight based on the total weight of the ink.

The above components are principal components of the ink-jet printing inks used in the process of the present invention. However, general organic solvents may also be used in combination with water as other components of the liquid medium for the inks. Examples thereof include ketones and keto-alcohols such as acetone and diacetone alcohol; ethers such as tetrahydrofuran and dioxane; addition polymers of oxyethylene or oxypropylene with diethylene glycol, triethylene glycol, tetraethylene glycol, dipropylene glycol, tripropylene glycol, polyethylene glycol, polypropylene glycol and the like; alkylene glycols the alkylene moiety of which has 2 to 6 carbon atoms, such as ethylene glycol, propylene glycol, trimethylene glycol, butylene glycol and hexylene glycol; thiodiglycol; triols such as 1,2,6-hexanetriol and glycerol; lower alkyl ethers of polyhydric alcohols, such as ethylene glycol monomethyl (or monoethyl) ether, diethylene glycol monomethyl (or monoethyl) ether and triethylene glycol monomethyl (or monoethyl) ether; lower dialkyl ethers of polyhydric alcohols, such as triethylene glycol dimethyl (or diethyl) ether and tetraethylene glycol dimethyl (or diethyl) ether; sulfolane; N-methyl-2-pyrrolidone; and 1,3-dimethyl-2-imidazolidinone.

The content of the water-soluble organic solvent as described above is generally within a range of from 3 to 60% by weight, preferably from 5 to 50% by weight based on the total weight of the ink.

The liquid medium components as described above may be used either singly or in any combination thereof if used in combination with water. However, the most preferred composition of the liquid medium is that comprising at least one polyhydric alcohol as such a solvent. Among others, a single solvent of thiodiglycol or a mixed solvent system of diethylene glycol and thiodiglycol is particularly preferred.

Although the principal components of the inks used in the process of the present invention are as described above, a variety of other additives such as a dispersant, a surfactant, a viscosity modifier, a surface tension modifier and an optical whitening agent may be added to the inks as needed.

Examples of such additives may include viscosity modifiers such as polyvinyl alcohol and water-soluble resins; various anionic or nonionic surfactants; surface tension modifiers such as diethanolamine and triethanolamine; pH adjustors comprising a buffer solution; mildewproofing agents; and the like.

The ink-jet printing process of the present invention is a process in which the printing inks as described above are used to conduct textile printing on the ink-jet printing cloth according to the present invention. An ink-jet printing system used may be any conventionally-known ink-jet recording system. However, the method described in Japanese Patent Application Laid-Open No. 54-59936, i.e., a system in which thermal energy is applied to an ink so as to undergo rapid volume change, and the ink is ejected from an orifice by action force caused by this change of state is the most effective method. When printing is conducted on the ink-jet printing cloth according to the present invention by such a system, stable printing is feasible.

As conditions under which a print particularly high in effect can be obtained, it is preferred that an ejected ink droplet be within a range of from 20 to 200 pl, a shot-in ink quantity be within a range of from 4 to 40 nl/mm$^2$, and an adhered amount of dye be within a range of from 0.025 to 1 mg/cm$^2$.

As an illustrative example of an apparatus, which is suitable for use in conducting textile printing using the ink-jet printing cloths according to the present invention, may be mentioned an apparatus in which thermal energy corresponding to recording signals is applied to an ink within a recording head, and ink droplets are generated in accordance with the thermal energy.

Figure 2:
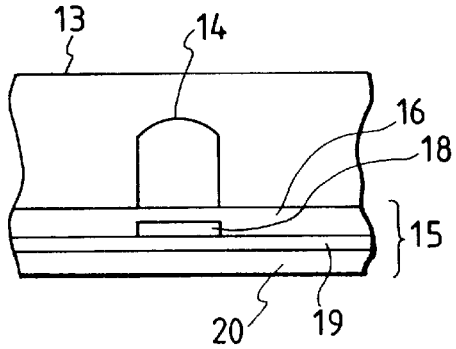
FIG. 2 is a transverse cross-sectional view of the head of the ink-jet recording apparatus.
Figure 3:
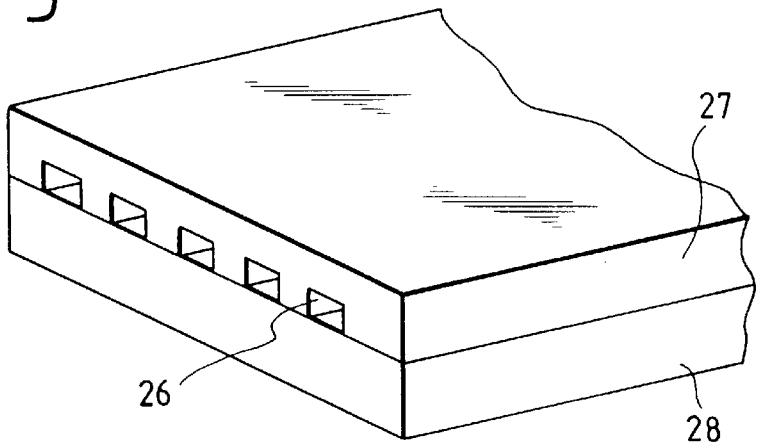
FIG. 3 is a perspective view of the appearance of a multi-head which is an array of such heads as shown in FIG. 1.

Examples of the construction of an head, which is a main component of such an apparatus, are illustrated in FIGS. 1, 2 and 3.

A head 13 is formed by bonding a glass, ceramic or plastic plate or the like having a groove 14 through which an ink is passed, to a heating head 15, which is used for thermal recording (the drawing shows a head to which, however, is not limited). The heating head 15 is composed of a protective film 16 made of silicon oxide or the like, aluminum electrodes 17-1 and 17-2, a heating resistor layer 18 made of nichrome or the like, a heat accumulating layer 19, and a substrate 20 made of alumina or the like having a good heat radiating property.

An ink 21 comes up to an ejection orifice (a minute opening) 22 and forms a meniscus 23 owing to a pressure P.

Now, upon application of electric signals to the electrodes 17-1, 17-2, the heating head 15 rapidly generates heat at the region shown by n to form bubbles in the ink 21 which is in contact with this region. The meniscus 23 of the ink is projected by the action of the pressure thus produced, and the ink 21 is ejected from the orifice 22 to a cloth 25 of the present invention composed mainly of silk fibers in the form of recording droplets 24. FIG. 3 illustrates an appearance of a multi-head composed of an array of a number of heads as shown in FIG. 1. The multi-head is formed by closely bonding a glass plate 27 having a number of channels 26 to a heating head 28 similar to the head as illustrated in FIG. 1. Incidentally, FIG. 1 is a cross-sectional view of the head 13 taken along the flow path of the ink, and FIG. 2 is a cross-sectional view taken along line 2—2 in FIG. 1.

Figure 4:
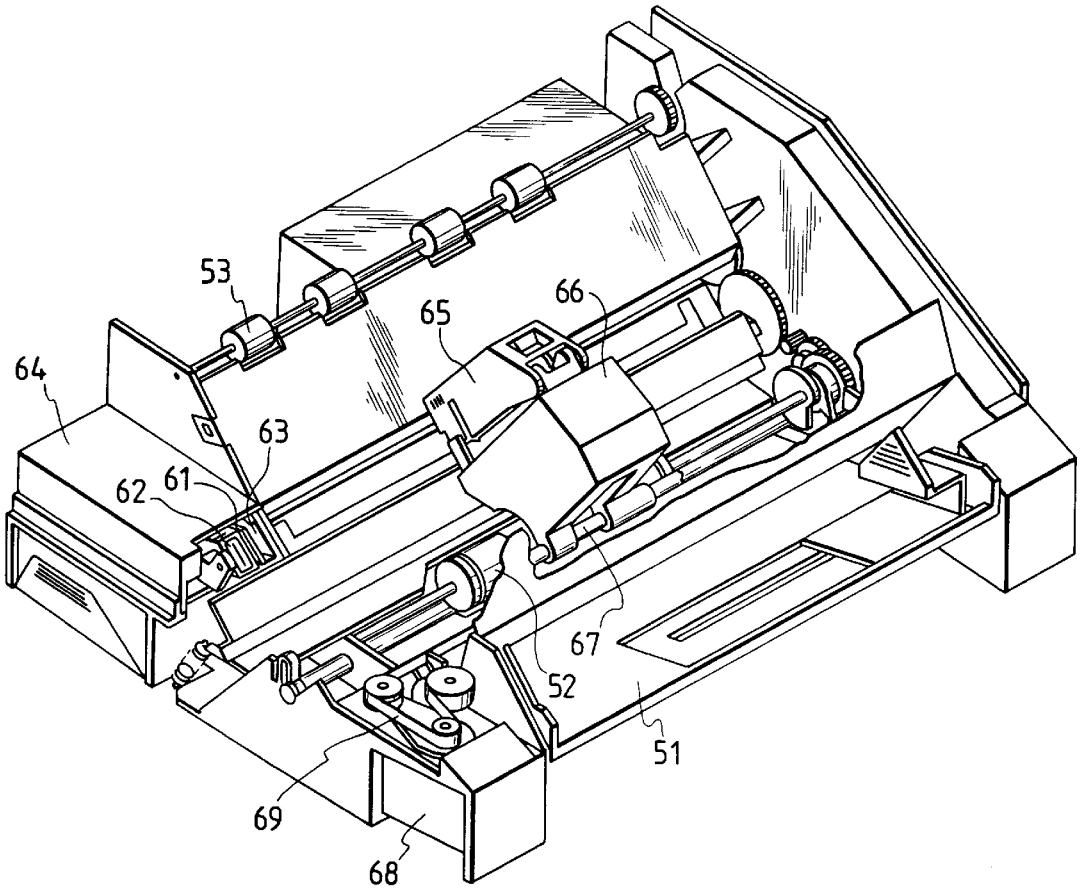
FIG. 4 is a perspective view of an illustrative ink-jet recording apparatus.

FIG. 4 illustrates an example of an ink-jet recording apparatus in which such a head has been incorporated.

In FIG. 4, reference numeral 61 designates a blade serving as a wiping member, one end of which is a stationary end held by a blade-holding member to form a cantilever. The blade 61 is provided at the position adjacent to the region in which a recording head operates, and in this embodiment, is held in such a form that it protrudes to the course through which the recording head is moved. Reference numeral 62 indicates a cap, which is provided at the home position adjacent to the blade 61, and is so constituted that it moves in the direction perpendicular to the direction in which the recording head is moved and comes into contact with the face of ejection openings to cap it. Reference numeral 63 denotes an absorbing member provided adjoiningly to the blade 61 and, similar to the blade 61, held in such a form that it protrudes to the course through which the recording head is moved. The above-described blade 61, cap 62 and absorbing member 63 constitute an ejection-recovery portion 64, where the blade 61 and absorbing member 63 remove water, dust and/or the like from the face of the ink-ejecting openings.

Reference numeral 65 designates the recording head having an ejection-energy-generating means and serving to eject the ink onto the silk fiber-containing cloth set in an opposing relation with the ejection opening face provided with ejection openings to conduct recording. Reference numeral 66 indicates a carriage on which the recording head 65 is mounted so that the recording head 65 can be moved. The carriage 66 is slidably interlocked with a guide rod 67 and is connected (not illustrated) at its part to a belt 69 driven by a motor 68. Thus, the carriage 66 can be moved along the guide rod 67 and hence, the recording head 65 can be moved from a recording region to a region adjacent thereto.

Reference numerals 51 and 52 denote a cloth feeding part from which the cloths of the present invention composed mainly of silk fibers are separately inserted, and cloth feed rollers driven by a motor (not illustrated), respectively. With such construction, the cloth according to the present invention is fed to the position opposite to the ejection opening face of the recording head, and discharged from a cloth discharge section provided with cloth discharge rollers 53 with the progress of recording.

In the above constitution, the cap 62 in the head recovery portion 64 is receded from the moving course of the recording head 65 when the recording head 65 is returned to its home position, for example, after completion of recording, and the blade 61 remains protruded to the moving course. As a result, the ejection opening face of the recording head 65 is wiped. When the cap 62 comes into contact with the ejection opening face of the recording head 65 to cap it, the cap 62 is moved so as to protrude to the moving course of the recording head.

When the recording head 65 is moved from its home position to the position at which recording is started, the cap 62 and the blade 61 are at the same positions as the positions upon the wiping as described above. As a result, the ejection opening face of the recording head 65 is also wiped at the time of this movement. The above movement of the recording head to its home position is made not only when the recording is completed or the recording head is recovered for ejection, but also when the recording head is moved between recording regions for the purpose of recording, during which it is moved to the home position adjacent to each recording region at given intervals, where the ejection opening face is wiped in accordance with this movement.

The printing inks applied onto the ink-jet printing cloth of this invention in accordance with the process of the present invention in the above-described manner only adhere to the cloth in this state. Accordingly, it is preferable to subsequently subject the cloth to a process for reactively fixing the dyes in the inks to the fibers and a process for removing unfixed dyes.

A steaming process is a fixing process by which the effects of the present invention are particularly markedly exhibited. Among others, a high-temperature printing process using an HT steamer is preferred. Conditions of at least 103° C., or at least 105° C. according to dyes to be used are temperature conditions which can have a marked effect on stability to coloring compared with the conventional cloths.

The washing may be conducted in accordance with any conventionally known method.

The present invention will hereinafter be described more specifically by the following Examples and Comparative Examples. Incidentally, all designations of "part" or "parts" and "%" as will be used in the following examples mean part or parts by weight and % by weight unless expressly noted.

Preparation of Ink (A):

| | |
|---|---|
| Reactive dye (C.I. Reactive Yellow 95) | 10 parts |
| Thiodiglycol | 24 parts |
| Diethylene glycol | 11 parts |
| Potassium chloride | 0.004 part |
| Sodium sulfate | 0.002 part |
| Sodium metasilicate | 0.001 part |
| Iron chloride | 0.0005 part |
| Water | 55 parts. |

All the above components were mixed, and the liquid mixture was adjusted to pH 8.4 with sodium hydroxide. After stirring the mixture for 2 hours, it was filtered through a "Fluoropore Filter FP-100" (trade name; product of Sumitomo Electric Industries, Ltd.), thereby obtaining Ink-Jet Printing Ink (A).

Preparation of Ink (B):

| | |
|---|---|
| Reactive dye (C.I. Reactive Red 266) | 10 parts |
| Thiodiglycol | 15 parts |
| Diethylene glycol | 10 parts |
| Tetraethylene glycol dimethyl ether | 5 parts |
| Potassium chloride | 0.04 part |
| Sodium sulfate | 0.01 part |
| Sodium metasilicate | 0.001 part |
| Iron chloride | 0.0005 part |
| Nickel chloride | 0.0002 part |
| Water | 60 parts. |

All the above components were mixed, and the liquid mixture was adjusted to pH 7.9 with sodium hydroxide. After stirring the mixture for 2 hours, it was filtered through a "Fluoropore Filter FP-100" (trade name; product of Sumitomo Electric Industries, Ltd.), thereby obtaining Ink-Jet Printing Ink (B).

Preparation of Ink (C):

| | |
|---|---|
| Reactive dye (C.I. Reactive Blue 15) | 13 parts |
| Thiodiglycol | 23 parts |
| Triethylene glycol monomethyl ether | 6 parts |
| Potassium chloride | 0.05 part |
| Sodium metasilicate | 0.001 part |
| Iron chloride | 0.0005 part |
| zinc chloride | 0.0003 part |
| Water | 58 parts. |

All the above components were mixed, and the liquid mixture was adjusted to pH 8.3 with sodium hydroxide. After stirring the mixture for 2 hours, it was filtered through a "Fluoropore Filter FP-100" (trade name; product of Sumitomo Electric Industries, Ltd.), thereby obtaining Ink-Jet Printing Ink (C).

Preparation of Ink (D):

| | |
|---|---|
| Reactive dye (C.I. Reactive Brown 11) | 2 parts |
| Reactive dye (C.I. Reactive Orange 12) | 1.5 parts |
| Reactive dye (C.I. Reactive Black 39) | 6.5 parts |
| Thiodiglycol | 23 parts |
| Diethylene glycol | 5 parts |
| Isopropyl alcohol | 3 parts |
| Potassium sulfate | 0.01 part |
| Sodium metasilicate | 0.001 part |
| Iron sulfate | 0.0005 part |
| Nickel sulfate | 0.0003 part |
| Zinc sulfate | 0.0003 part |
| Water | 59 parts. |

All the above components were mixed, and the liquid mixture was adjusted to pH 8.2 with sodium hydroxide. After stirring the mixture for 2 hours, it was filtered through a "Fluoropore Filter FP-100" (trade name; product of Sumitomo Electric Industries, Ltd.), thereby obtaining Ink-Jet Printing Ink (D).

EXAMPLE 1

A 100% silk woven fabric formed of silk yarn having an average thickness of 22 deniers, which was composed of silk fibers having an average thickness of 3 deniers, was immersed in an aqueous solution containing 1% of sodium hydrogencarbonate, 10% of urea and 1% of sodium alginate, squeezed to a pickup of 60% and then dried to adjust the moisture regain of the fabric to 20%.

Ink-Jet Printing Inks (A through D) obtained in the above-described manner were charged in a "Color Bubble Jet Printer BJC-820J" (trade name, manufactured by Canon Inc.) to print solid print samples of 2×10 cm on the thus-pretreated woven fabric under conditions of a shot-in ink quantity of 16 nl/mm$^2$. The solid print samples of each color were fixed by steaming treatments for 8 minutes at 102° C., 103° C., 105° C. and 110° C., respectively. Thereafter, these print samples were washed to evaluate the resulting prints in color depth. The results are shown in Table 1. At each steaming temperature, all the prints of the individual colors were good in resistance to bleeding and brightness.

Upon elapsed time of 1 month after the treatment of the fabric, the same test was conducted. As a result, the storage stability of the fabric was also good.

EXAMPLE 2

The same woven fabric as that used in Example 1 was immersed in an aqueous solution containing 0.1% of sodium hydroxide, 10% of urea and 1% of sodium alginate, squeezed to a pickup of 60% and then dried to adjust the moisture regain of the fabric to 20%.

Using this woven fabric, printing, fixing and washing were conducted in the same manner as in Example 1 to evaluate the resulting prints in color depth. The results are shown in Table 1. At each steaming temperature, all the prints of the individual colors were good in resistance to bleeding and brightness.

EXAMPLE 3

A 100% silk woven fabric formed of silk yarn having an average thickness of 30 deniers, which was composed of silk fibers having an average thickness of 2.7 deniers, was immersed in an aqueous solution containing 0.5% of sodium carbonate, 10% of urea and 1% of sodium alginate, squeezed to a pickup of 60% and then dried to adjust the moisture regain of the fabric to 20%.

Using this woven fabric, printing, fixing and washing were conducted in the same manner as in Example 1 to evaluate the resulting prints in color depth. The results are shown in Table 1. At each steaming temperature, all the prints of the individual colors were good in resistance to bleeding and brightness.

EXAMPLE 4

A 100% silk woven fabric formed of silk yarn having an average thickness of 22 deniers, which was composed of silk fibers having an average thickness of 3 deniers, was immersed in an aqueous solution containing 2% of sodium hydrogencarbonate, 10% of urea and 1% of sodium alginate (the pH of which was adjusted to 8.1 with sodium m-nitrobenzenesulfonate), squeezed to a pickup of 60% and then dried to adjust the moisture regain of the fabric to 20%. The surface pH of this fabric was measured and found to be 8.0.

Using this woven fabric, printing, fixing and washing were conducted in the same manner as in Example 1 to evaluate the resulting prints in color depth. The results are shown in Table 1. At each steaming temperature, all the prints of the individual colors were good in resistance to bleeding and brightness.

EXAMPLE 5

The same woven fabric as that used in Example 4 was immersed in an aqueous solution containing 2% of sodium carbonate, 10% of urea and 1% of sodium alginate (the pH of which was adjusted to 7.0 with acetic acid), squeezed to a pickup of 60% and then dried to adjust the moisture regain of the fabric to 20%. The surface pH of this fabric was measured and found to be 6.8.

Using this woven fabric, printing, fixing and washing were conducted in the same manner as in Example 1 to evaluate the resulting prints in color depth. The results are shown in Table 1. At each steaming temperature, all the prints of the individual colors were good in resistance to bleeding and brightness.

EXAMPLE 6

A 100% silk woven fabric formed of silk yarn having an average thickness of 30 deniers, which was composed of silk fibers having an average thickness of 2.7 deniers, was immersed in an aqueous solution containing 3% of sodium carbonate, 10% of urea and 1% of sodium alginate (the pH of which was adjusted to 7.5 with sodium m-nitrobenzenesulfonate), squeezed to a pickup of 60% and then dried to adjust the moisture regain of the fabric to 20%. The surface pH of this fabric was measured and found to be 7.5.

Using this woven fabric, printing, fixing and washing were conducted in the same manner as in Example 1 to evaluate the resulting prints in color depth. The results are shown in Table 1. At each steaming temperature, all the prints of the individual colors were good in resistance to bleeding and brightness.

EXAMPLE 7

The same woven fabric as that used in Example 6 was immersed in an aqueous solution containing 5% of sodium hydrogencarbonate, 10% of urea and 1% of sodium alginate (the pH of which was adjusted to 6.0 with acetic acid), squeezed to a pickup of 60% and then dried to adjust the moisture regain of the fabric to 20%. The surface pH of this fabric was measured and found to be 6.1.

Using this woven fabric, printing, fixing and washing were conducted in the same manner as in Example 1 to evaluate the resulting prints in color depth. The results are shown in Table 1. At each steaming temperature, all the prints of the individual colors were good in resistance to bleeding and brightness.

COMPARATIVE EXAMPLE 1

The same woven fabric as that used in Example 1 was immersed in an aqueous solution containing 2.5% of sodium hydrogencarbonate, 10% of urea and 1% of sodium alginate, squeezed to a pickup of 60% and then dried to adjust the moisture regain of the fabric to 20%. The surface pH of this fabric was measured and found to be 9.2.

Using this woven fabric, printing, fixing and washing were conducted in the same manner as in Example 1 to evaluate the resulting prints in color depth. As shown in Table 1, the results revealed that this fabric was poor in coloring ability upon high-temperature steaming as to some of the inks compared with the fabric of Example 1.

COMPARATIVE EXAMPLE 2

The same woven fabric as that used in Example 1 was immersed in an aqueous solution containing 1.5% of sodium carbonate, 10% of urea and 1% of sodium alginate, squeezed to a pickup of 60% and then dried to adjust the moisture regain of the fabric to 20%. The surface pH of this fabric was measured and found to be 10.0.

Using this woven fabric, printing, fixing and washing were conducted in the same manner as in Example 1 to evaluate the resulting prints in color depth. As shown in Table 1, the results revealed that this fabric was poor in coloring ability upon high-temperature steaming as to all the inks compared with the fabric of Example 1.

COMPARATIVE EXAMPLE 3

The same woven fabric as that used in Example 1 was immersed in an aqueous solution containing 0.01% of sodium carbonate, 10% of urea and 1% of sodium alginate, squeezed to a pickup of 60% and then dried to adjust the moisture regain of the fabric to 20%.

Using this woven fabric, printing, fixing and washing were conducted in the same manner as in Example 1 to evaluate the resulting prints in color depth. As a result, it was revealed that dyeing itself was insufficient, and the color depth of the prints was hence lower. As shown in Table 1, the relative color depth was also poor.

COMPARATIVE EXAMPLE 4

The same woven fabric as that used in Example 4 was immersed in an aqueous solution containing 2% of sodium hydrogencarbonate, 10% of urea and 1% of sodium alginate (the pH of which was adjusted to 8.5 with sodium m-nitrobenzenesulfonate), squeezed to a pickup of 60% and then dried to adjust the moisture regain of the fabric to 20%. The surface pH of this fabric was measured and found to be 8.4.

Using this woven fabric, printing, fixing and washing were conducted in the same manner as in Example 1 to evaluate the resulting prints in color depth. As shown in Table 1, the results revealed that this fabric was poor in coloring ability upon high-temperature steaming as to some of the inks compared with the fabric of Example 1.

COMPARATIVE EXAMPLE 5

The same woven fabric as that used in Example 4 was immersed in an aqueous solution containing 2% of sodium carbonate, 10% of urea and 1% of sodium alginate (the pH of which was not adjusted), squeezed to a pickup of 60% and then dried to adjust the moisture regain of the fabric to 20%. The surface pH of this fabric was measured and found to be 9.0.

Using this woven fabric, printing, fixing and washing were conducted in the same manner as in Example 1 to evaluate the resulting prints in color depth. As shown in Table 1, the results revealed that this fabric was poor in coloring ability upon high-temperature steaming as to all the inks compared with the fabric of Example 1.

COMPARATIVE EXAMPLE 6

The same woven fabric as that used in Example 6 was immersed in an aqueous solution containing 3% of sodium carbonate, 10% of urea and 1% of sodium alginate (the pH of which was adjusted to 9 with acetic acid), squeezed to a pickup of 60% and then dried to adjust the moisture regain of the fabric to 20%. The surface pH of this fabric was measured and found to be 9.1.

Using this woven fabric, printing, fixing and washing were conducted in the same manner as in Example 1 to evaluate the resulting prints in color depth. As shown in Table 1, the results revealed that this fabric was poor in coloring ability upon high-temperature steaming as to all the inks compared with the fabric of Example 1.

TABLE 1

| Evaluated*1 | Example | | | | | | | Comparative Example | | | | | |
|---|---|---|---|---|---|---|---|---|---|---|---|---|---|
| item | 1 | 2 | 3 | 4 | 5 | 6 | 7 | 1 | 2 | 3 | 4 | 5 | 6 |
| Color depth at 103° C. | A | A | A | A | A | A | A | A | B | B | A | B | B |
| Color depth at 105° C. | A | A | A | A | A | A | A | B | C | B | B | C | B |
| Color depth at 110° C. | A | A | A | A | A | A | A | C | C | B | C | C | C |

*1Ranked in terms of the relative color depth to the color depth measured upon the steaming treatment at 102° C. in accordance with the following standard. Incidentally the relative color depth was determined in accordance with the following equation:

$$\text{Relative color depth} = \frac{(\text{The K/S value at the evaluated temperature})}{(\text{The K/S value at 102° C.})}$$

wherein K/S value = $(1 - R)^2/2R$ (R: reflectance at a maximum absorption wavelength).

A: Relative color depth was at least 0.95 in all the colors;

B: Relative color depth was reduced to 0.94 down to 0.5 in some of the inks;

C: Relative color depth was reduced to 0.49 or lower in some of the inks.

According to the textile printing cloths of the present invention, as described above, there can be solved the problem of image that a bright print free of ink bleeding and high in color depth is provided, the problem of quality that coloring ability in high-temperature fixing is stable, the problem of cost that the color yield of ink is good, the problem of operating characteristics or properties such as storage stability and feedability in apparatus of treated cloth, etc. at the same time.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. A process for preparing a printed cloth comprising the steps of:

(i) providing a cloth composed mainly of silk fibers and containing an alkaline substance and an organic acid, the amount of the alkaline substance, including that forming a salt with the organic acid, being not less than 0.8% by weight based on the dry weight of the cloth;

(ii) applying an ink containing a reactive dye to the cloth;

(iii) heating the cloth resulting from step (ii) at a temperature of 103° C. or higher; and (iv) washing the cloth resulting from step (iii), wherein a surface pH of the cloth is in a range of from 6 to 8.2, and wherein the alkaline substance is at least one substance selected from the group consisting of alkali metal hydroxides and alkali metal carbonates and bicarbonates.

2. The process according to claim 1, wherein the reactive dye adheres to the cloth in an amount of 0.025 to 1 mg/cm$^2$.

3. A print produced by a process according to claim 1.

4. The print according to claim 3, wherein the reactive dye adheres to the cloth in an amount of 0.025 to 1 mg/cm$^2$.

5. The print according to claim 3, wherein the cloth is formed of silk yarn having an average thickness of 14 to 147 deniers, which is composed of silk fibers having an average thickness of 2.2 to 3.5 deniers.

6. The print according to claim 3, wherein the moisture regain of the cloth is 17 to 112% by weight.

7. The print according to claim 3, wherein the alkaline substance is sodium carbonate or sodium bicarbonate.

8. The print according to claim 3, wherein the cloth further contains at least one substance selected from the group consisting of water-soluble metal salts, water-soluble polymers, urea and thiourea in an amount of 0.01 to 20% by weight based on the dry weight of the cloth.

9. The print according to claim 3, wherein the surface pH of the cloth is adjusted to 6 to 8.

10. The print according to claim 3, wherein the surface pH of the cloth is adjusted to 6.5 to 8.

11. The print according to claim 3, wherein the ink contains the reactive dye in an a mount of 0.5 to 30% by weight of the ink.

12. The print according to claim 3, wherein the ink is a water-based ink.

13. The print according to claim 3, wherein the ink is applied to the cloth in accordance with thermal energy corresponding to printing signals.

14. The process according to claim 1, wherein the cloth is formed of silk yarn having an average thickness of 14 to 147 deniers, which is composed of silk fibers having an average thickness of 2.2 to 3.5 deniers.

15. The process according to claim 1, wherein the moisture regain of the cloth is 17 to 112% by weight.

16. The process according to claim 1, wherein the alkaline substance is sodium carbonate or sodium bicarbonate.

17. The process according to claim 1, wherein the cloth further contains at least one substance selected from the group consisting of water-soluble metal salts, water-soluble polymers, urea and thiourea in an amount of 0.01 to 20% by weight based on the dry weight of the cloth.

18. The process according to claim 1, wherein the surface pH of the cloth is adjusted to 6 to 8.

19. The process according to claim 1, wherein the surface pH of the cloth is adjusted to 6.5 to 8.

20. The process according to claim 1, wherein the ink contains the reactive dye in an amount of 0.5 to 30% by weight of the ink.

21. The process according to claim 1, wherein the ink is a water-based ink.

22. The process according to claim 1, wherein the ink is applied to the cloth in accordance with thermal energy corresponding to printing signals.

23. A process for improving color development of a print on a cloth containing silk fibers without deteriorating smoothness of the silk, the print being formed on the cloth by (i) applying an aqueous ink containing a reactive dye with an ink-jet printing machine to the cloth, (ii) heating the cloth resulting from step (i) at a temperature of 103° C. or higher, and (iii) washing the cloth resulting from step (ii), said process comprising the step of pre-treating the cloth which is to be used for step (i) with a solution containing an alkaline substance and an organic acid so that the cloth contains the alkaline substance in an amount of not less than 0.8% by weight based on the dry weight of the cloth, the amount of the alkaline substance including that forming a salt with the organic acid, and so that the cloth has a surface pH of 6 to 8.2, wherein the alkaline substance is selected from the group consisting of alkali metal hydroxides and alkali metal carbonates and bicarbonates.

24. A process for preparing a printed cloth comprising the steps of:

i) providing a cloth composed mainly of silk fibers, and containing an alkaline substance;

ii) applying an ink containing a reactive dye to the cloth;

iii) heating the cloth to which the ink has been applied at a temperature of 103° C. or higher; and iv) washing the cloth resulting from step (iii), wherein step (i) comprises the sub-steps of:

(a) determining whether an amount of the alkaline substance in the cloth ranges from 0.01 to 0.8% by weight of the dry weight of the cloth, or exceeds 0.8% by weight of the dry weight of the cloth; and (b) subjecting the cloth to step (ii) without any further treatment when the alkaline substance is contained in the cloth in an amount of 0.01 to 0.8 wt. %, or subjecting the cloth to a treatment with an acid so that pH of the surface of the cloth according to Surface pH Measurement of Paper and Paperboard prescribed by Japan Technical Association of the Pulp and Paper Industry is 8.2 or lower when the amount of the alkaline substance in the cloth exceeds 0.8 wt. %.

25. The process according to claim 24, wherein the alkaline substance is selected from the group consisting of alkai metal hydroxides and alkali metal carbonates and bicarbonates.

26. The process according to claim 24, wherein the treatment with an acid is conducted so that the pH of the surface of the cloth is in the range of 6 to 8.2.

27. A process for producing a printed cloth comprising the steps of:

(i) providing a cloth composed mainly of silk fibers;

(ii) applying an alkaline substance to the cloth;

(iii) applying an ink containing a reactive dye to the cloth with an ink-jet printing machine;

(iv) heating the cloth resulting from step (iii) at a temperature of 103°C. or higher; and (v) washing the cloth resulting from step (iii), the process further comprising the steps of (a) and (b) between steps (ii) and (iii):

(a) determining whether the amount of the alkaline substance applied to the cloth in step (ii) ranges from 0.01 to 0.8% by weight of the dry weight of the cloth, or not less than 0.8% by weight of the dry weight of the cloth; and (b)

(1) subjecting the cloth to step (iii) without any further treatment when the alkaline substance applied to the cloth is in the range of 0.01 to 0.8% by weight of the dry weight of the cloth according to step (a)

(2) determining whether the surface pH of the cloth according to Surface pH Measurement of Paper and Paperboard prescribed by Japan Technical Association of the Pulp and Paper Industry is in the range of 6 to 8.2 when the alkaline substance applied to the cloth in step (ii) is not less than 0.8% by weight of the dry weight of the cloth according to step (a);

(3) subjecting the cloth to step (iii) without any further treatment when the surface pH of the cloth is in the range of 6 to 8.2 according to step (b) (2);

(4) adjusting the surface pH of the cloth to be in the range of 6 to 8.2 and then subjecting the cloth to step (iii) when the surface pH of the cloth exceeds 8.2 according to step (b) (2).

28. The process according to claim 27, wherein the alkaline substance is selected from the group consisting of alkali metal hydroxides and alkali metal carbonates and bicarbonates.

29. The process to claim 27, wherein step (b) (2) includes adjusting the surface pH of the cloth to be in the range of 5 to 8.2 with an organic acid.

30. A process for preparing a printed cloth comprising the steps of:

(i) applying an ink containing a reactive dye to a cloth mainly composed of silk fibers with an ink-jet printing machine;

(ii) heating the cloth resulting from step (i) at a temperature of 103°C. or higher; and (iii) washing the cloth resulting from step (ii), the process further comprising the sub-steps of:

(a) applying an alkaline substance selected from the group consisting of alkali metal hydroxides and alkali metal carbonates and bicarbonates so that the cloth contains the alkaline substance in an amount of not less than 0.8% by weight of the dry weight of the cloth; and (b) adjusting the surface pH of the cloth resulting from sub-step (a) to be in the range of 6 to 8.2, wherein sub-steps (a) and (b) are performed before step (i).

31. The process according to claim 30, wherein sub-step (b) includes treating the cloth resulting from sub-step (a) with an organic acid so as to adjust the surface pH of the cloth to be in the range of 6 to 8.2.

32. The process according to claim 31, wherein the organic acid is selected from the group consisting of nitrobenezesulfonic acid, a salt thereof, acetic acid and a salt thereof.

* * * * *

UNITED STATES PATENT AND TRADEMARK OFFICE

CERTIFICATE OF CORRECTION

PATENT NO. : 6,394,597 B1
DATED : May 28, 2002
INVENTOR(S) : Koike et al.

It is certified that error appears in the above-identified patent and that said Letters Patent is hereby corrected as shown below:

Title page,
Item [56], References Cited, FOREIGN PATENT DOCUMENTS, "0620116" should read -- 0 620 116 --; "61132687" should read -- 61-132687 --; and "62299588" should read -- 62-299588 --.
*Assistant Examiner*, "Brook" should read -- Brooke --.

Column 1,
Line 19, "requires" should read -- require --;
Line 21, "difficult" should read -- are unsuited --; and
Line 59, "offers" should read -- offer --.

Column 3,
Line 9, "extremely" should be deleted.

Column 5,
Line 5, the following should be inserted:

| | |
|---|---|
| --Tetrabromphenol blue (T.B.P.B.) | measured pH: 2.4-4.4 |
| Bromcresol green (B.C.G.) | measured pH: 3.4-5.4 |
| Bromcresol purple (B.C.P.) | measured pH: 4.8-5.8 |
| Bromthymol blue (B.T.B.) | measured pH: 6.0-8.0 |
| Cresol red (C.R.) | measured pH: 6.8-8.8 |
| Thymol blue (T.B.) | measured pH: 8.0-10.0 |

(According to the catalog of pH meter for surface measurement of paper (Kyoritsu Rikagaku Kenkyusyo).)

(2) Standard pH of change color.
(3) Cotton wool.

It is certified that error appears in the above-identified patent and that said Letters Patent is hereby corrected as shown below:

The indicators and standard pH of change color are available from Kyoritsu Rikagaku Kenkyusyo.

Test paper: Two test papers, optionally the size of an original paper, are used.

Test process: The indicator for pH measurement is dropped to the surface to be measured, and spread thinly with cotton wool or the like. After 1-2 minutes, at the time that the indicator is not quite dried and the even color is bright, it is compared with the above standard pH of change color. The pH is measured to the first decimal place. It is necessary to prevent excessive drying, which causes movement to acidity.

ONE DROPPING EXTRACTION METHOD

Instruments and reagents:

1. Indicators for pH measurement: The indicators are prepared in accordance with JIS K 8004 (reagent general test method).

| | |
|---|---|
| Bromphenyl blue (B.P.B.) | measured pH: 2.8-4.4 |
| Bromcresol green (B.C.G.) | measured pH: 4.0-5.6 |
| Methyl red (M.R.) | measured pH: 5.4-7.0 |
| Bromthymol blue (B.T.B.) | measured pH: 6.4-7.8 |
| Phenol red (P.R.) | measured pH: 6.6-8.2 |
| Cresol red (C.R.) | measured pH: 7.2-8.8 |
| Thymol blue (T.B.) | measured pH: 8.0-9.6 |

It is certified that error appears in the above-identified patent and that said Letters Patent is hereby corrected as shown below:

2. Standard and standard pH of change color: These are available from Toyo Kagaku Sangyo K.K.

Test paper: The same as those in the Method of Application.

Test process: The indicator for pH measurement is added by one drop (approximately 0.04 ml) to the surface to be measured. The test paper is held horizontally and shaken to the front, back, left and right to expand the indicator to 20 mm in diameter. Then, the test paper is inclined to the right, back, front and left in order that the unabsorbed indicator flows with rotation on the surface, whereby the water soluble substance in the surface layer is extracted to the indicator. When the indicator is fully absorbed, it is added. Next, the test paper is leaned at an incline and the unabsorbed indicator is collected. The hue of the collected unabsorbed indicator on the surface is compared with a standard and standard pH of change color to measure the pH of the indicator to the first decimal place.

SURFACE RELEASE EXTRACTION METHOD

Equipment and instruments:

(1) Razor Blade.
(2) Beaker (100 ml.)
(3) Hard glass stick for mixing.
(4) Chemical scale, maximum weight 200 g, weight sensitivity 1 mg.
(5) Glass electrode pH meter.
(6) Graduated cylinder (50 ml).

Test paper: The same as those in the Method of Application.
Test process: The coated layer of the test paper is shaved using a razor blade to collect approximately 0.12 g thereof. The collected paper is put in a 100 ml beaker, and then 50 ml of water (distilled water that does not contain carbon dioxide or desalted water purified with anion-exchange resin) is added, stirred and left for one hour. Then it is stirred further, and the pH of the extracted solution is measured to the first decimal place.--.

UNITED STATES PATENT AND TRADEMARK OFFICE

CERTIFICATE OF CORRECTION

PATENT NO. : 6,394,597 B1
DATED : May 28, 2002
INVENTOR(S) : Koike et al.

It is certified that error appears in the above-identified patent and that said Letters Patent is hereby corrected as shown below:

Column 6,
Line 7, “preferred embodiments” should read -- a preferred embodiment --.

Column 7,
Line 33, “an” should read -- a --; and
Line 39, “however, is” should read -- however, the invention is --.

Column 14,
Line 2, “to the” should read -- the --; and
Line 44, “a mount” should read -- amount --.

Column 15,
Line 17, “said” should begin a new paragraph.

Column 16,
Line 16, “step (a)” should read -- step (a); --;
Line 27, “step (b) (2);” should read -- step (b) (2); and --; and
Line 36, “process” should read -- process according --.

Signed and Sealed this

Twenty-seventh Day of May, 2003

JAMES E. ROGAN
*Director of the United States Patent and Trademark Office*